United States Patent [19]

Bayewitz

[11] 4,432,790

[45] Feb. 21, 1984

[54] BLAST FURNACE CONTROL METHOD

[75] Inventor: Marvin H. Bayewitz, Allentown, Pa.

[73] Assignee: Bethlehem Steel Corporation, Bethlehem, Pa.

[21] Appl. No.: 391,329

[22] Filed: Jun. 23, 1982

Related U.S. Application Data

[63] Continuation-in-part of Ser. No. 237,331, Feb. 23, 1981, abandoned.

[51] Int. Cl.[3] ..... C21B 5/06

[52] U.S. Cl. ..... 75/41; 266/44; 266/80; 266/84

[58] Field of Search ..... 75/41, 42; 266/44, 80, 266/84

[56] References Cited

U.S. PATENT DOCUMENTS 3,719,811 3/1973 Munson ..... 266/80

4,227,921 10/1980 Matoba et al. ..... 75/41

*Primary Examiner*—M. J. Andrews

*Attorney, Agent, or Firm*—John I. Iverson; John S. Simitz

[57] ABSTRACT

A method for maintaining a uniform stable operation of a blast furnace susceptible to erratic behavior because of large disturbances introduced into the furnace is described. The method includes:

(a) determining a high temperature heat parameter (HTH) over a predetermined period of time, (b) determining a CEEP parameter over a predetermined period of time, (c) comparing the differences between the HTH and the CEEP parameters and their respective averages during selected time periods of operation, and (d) changing the temperature and/or moisture content of the hot blast air dependent upon the values in step (c).

25 Claims, No Drawings

BLAST FURNACE CONTROL METHOD

CROSS-REFERENCE OF THE INVENTION

This is a continuation-in-part of U.S. application Ser. No. 237,331 filed Feb. 23, 1981 in the name of Marvin H. Bayewitz and entitled "Blast Furnace Control Method," now abandoned.

BACKGROUND OF THE INVENTION

This invention in general is directed to a method for maintaining a substantially uniform and stable operation of a blast furnace and in particular to a blast furnace which is susceptible to erratic operation caused by the introduction of large disturbances into the furnace. The method is based on the differences in the average (HTH) and (CEEP) parameters and their values over a preselected period of operation. The differences are used to determine the changes to be made in the temperature and/or moisture content of the hot blast air introduced into the furnace.

High temperature heat, (HTH), is defined as the heat above about 1800° F. (980°C.) available in the tuyere region of the furnace to melt the burden, reduce the metalloids to their final state, reduce with carbon the FeO which has not been reduced by indirect reduction, heat the slag and hot metal to their final temperatures and be lost through the furnace wall. The tuyere region is defined as the lower portion of the blast furnace which includes the upper portion of the hearth wherein the tuyeres enter the furnace through the furnace wall, the tuyere raceway and the lower bosh.

The CEEP parameter is a linear function of the coke consumption ratio and reducing gas utilization factors. It is defined as:

$$CEEP=\{CCR-[(ETACO/90-1+[(ETAH2/90-1)/3])+0.6+1]\}/2+1$$

The coke consumption ratio, CCR, is the ratio of the quantity of coke reportedly consumed in the furnace over a preselected time period divided by the quantity of coke actually consumed in the process. The reducing gas utilization factors, ETACO and ETAH2, are the amount of carbon monoxide and hydrogen gases, respectively, that are used to reduce the iron oxides to iron divided by the amount of each gas that is theoretically possible to reduce the iron oxides to iron.

The production of hot metal, for example basic iron and foundry iron, in a blast furnace is very complex and is dependent upon many variables, for example uniformity and quality of materials, such as iron-containing ores and pellets, carbon-containing materials such as coke, and fluxstone, such as limestone, dolomite and the like which constitute the burden charged into the furnace, the flame temperature, slag volume, slag basicity, wind rate, ore/coke ratio, etc. As the burden moves downwardly in the furnace, hot gases pass upwardly through the burden and reduction-oxidation reactions between the hot gases and the burden materials occur at various levels in the furnace. In the upper level of the furnace, the reducing agents are the gases carbon monoxide and hydrogen and the reduction reactions, which are referred to as indirect reduction, are slightly endothermic. Reduction by solid carbon occurs in the lower stack of the furnace and this reaction, referred to as direct reduction, is highly endothermic. The heat necessary in the lower part of the furnace to melt the iron and slag and complete the reduction reactions is a function of the ore/coke ratio and the completeness of the indirect reduction reactions which occurred in the upper level of the furnace.

The reduction of silica to silicon, which occurs in the lower level of the furnace, is highly endothermic. Because only a portion of the silica charged into the furnace is reduced to silicon in the blast furnace by the endothermic reaction, any increase in the difference between the available heat and the necessary heat results in higher silicon levels in the hot metal. Stated more simply, as the high temperature heat in the furnace increases, or the necessary heat in the lower part of the furnace, as measured by the parameter CEEP decreases, the silicon content in the hot metal increases. Conversely, as the high temperature heat in the furnace decreases or the heat necessary in the lower part of the furnace increases, the silicon decreases. Therefore, knowing CEEP the high temperature heat in the furnace can be controlled to produce hot metal having a uniform chemistry.

Mass and heat balance calculations applicable to the operation of a blast furnace have been developed over the years to predict furnace performance. The mass and heat balance calculations can be solved manually and could be used by operators as a guide in the manual control of the furnace. The data collected are voluminous and much time is required to manually obtain mathematical solutions of the balances. It was, then, only natural that with the advent of computers, furnace operators would begin to use the computers to make the mass and heat balance calculations and use the results to aid in the control of the furnace.

In the past twenty or so years many feedforward and feedback control schemes have been proposed to control and to maintain a uniform operation of the furnace. Feedforward control schemes are designed to prevent the occurrence of disturbances in the furnace. Feedback control schemes are designed to reduce the effects of minor disturbances which occur in the furnace.

Feedback control schemes that use top gas data have been employed with varying degrees of success. Such schemes when used with ironmaking furnaces having raw material bedding and blending facilities have been used successfully. One such control scheme is described in U.S. Pat. No. 4,227,921 issued Oct. 14, 1980 to Yoshiyuki Matoba et al. entitled "Method of Controlling a Blast Furnace Operation" and teaches a method for controlling a blast furnace operation based on the assumptions that the working volume of the furnace can be vertically subdivided into a plurality of horizontal zones wherein in each zone predetermined reactions proceed uniformly, the amount of material in each zone does not vary significantly and reaction rates such as $\eta H_2$ are stable.

Another method for controlling a blast furnace is described in an article entitled "Development and Application of Computer Control System at Sakai No. 2 Blast Furnace" by Yajiro Fukagama et al. in the *Proceeding ICSTIS Section 1 Suppl. Trans. ISIJ,* Vol. 11, 1971, 143–147. The article teaches that a uniform and stable operation of a blast furnace can be achieved by the use of a computer control system based on a theoretical coke temperature determined from heat balance calculations which use accurate top gas analyses. However, as stated in the article, primary emphasis is placed on burden preparation because of its fundamental importance in stabilizing furnace conditions. It is necessary to maintain uniformity of the burden charged with regards to composition and weight. Consequently, such schemes when used with basic iron furnaces which are not equipped with bedding and blending facilities have not been successful and have been abandoned.

The results of a 2½ year study of blast furnace control in the blast furnace of August-Thyssen Steel at Ruhrort are detailed in the final report of a European Communities Commission, European Coal and Steel Community, Steel Research Reports, Pig Iron Production and Direct Reduction, "Automation of the Blast Furnace Process, Part 1: Plant Trials with Blast Furnace Control at the August-Thyssen Heutte A.G." issued in 1976. The work was done under Research Contract No. 6210-30/1/071 and was published under the auspices of the general directorate of Scientific and Technical Information and Information Management. The report shows that feedback control systems based on mass and heat balance calculations which use top gas analysis are not successful if large disturbances caused by inconsistent burden properties are introduced into the furnace. The result is not surprising in view of Staib et al., pioneers in the use of mass and heat balances for control of a blast furnace, who in their paper "Theoretical Considerations on the Automation of Blast Furnace Operation" presented at the Conference on Automation in Steelmaking, Amsterdam and Düsseldorf, Mar. 29–31 and Apr. 1–3, 1965 (English translation—BISI #4680, March 1966) stated that it is essential that the blast furnace burden composition be kept relatively constant because errors made in charging the furnace cannot be compensated for by heat control that is based on a calculated term. They further state that their techniques are valid only when the mass and heat transfers have a substantially steady-state nature.

In an article entitled "Burden Preparation and Computer Control of the Blast Furnace," in *Journal of Metals,* March 1968, pp. 68–74, J. M. VanLangen et al. also state that in using a calculated high temperature heat term for control it must be assumed that the furnace operates in a stationary state, i.e., burden composition and temperature are only a function of place and not of time. They further state that this implies that the ore burden composition and the coke to ore ratio are constant.

Also, Japanese reports by Fukagama et al. and Matoba et al., hereinbefore mentioned, base their feedback control methods on the calculated solid temperature in the lower part of the furnace and also assume that the furnace operation is uniform, i.e., free from the introduction of large disturbances into the furnace.

It has been concluded that feedback control schemes based on mass and heat balances can only be used when the necessary heat and the reducing gases required per ton of iron oxides reduced are constant. These requirements can only be met with a burden charge of raw materials having uniform compositions which add little if any "noise" (changes in variables, such as the physical and chemical properties of the burden charged through the top of the furnace) to the furnace operation.

There is, therefore, a need for a feedback control scheme that is capable of maintaining a substantially uniform operation of a blast furnace susceptible to the introduction of large disturbances.

It is an object of this invention to provide a feedback control scheme for maintaining a substantially uniform operation of a blast furnace susceptible to the introduction of large disturbances wherein accurate top gas data are continuously obtained and stored in a computer and averages of the top gas data are determined periodically and are used to compute the values of high temperature heat (HTH) and CEEP in the furnace by means of mass and heat balance calculations. The periodically determined values of high temperature heat (HTH) and CEEP are stored in the computer and averages of these periodically determined values are determined for preselected periods of blast furnace operation. The periodically determined values for high temperature heat (HTH) and CEEP are compared to their respective averages and these differences are used to determine changes which may be required to be made in the temperature and/or moisture content of the hot blast air to thereby maintain the aforementioned substantially uniform operation of the blast furnace and to produce a high quality hot metal having a consistently uniform chemistry characterized by a silicon content within a preselected range. The preselected period of operation for the average high temperature heat calculation is the most recent period during which the hot metal produced is characterized by a silicon content which is within a predetermined range of the aim silicon content. The preselected period of operation for CEEP is the period prior to the current period which could be as much as 24 hours or as recent as 9 hours.

SUMMARY OF THE INVENTION

According to this invention there is provided a feedback control scheme for controlling the operation of a blast furnace producing hot metal, particularly molten basic iron, which is based on a high temperature heat (HTH) parameter and a coke consumption-ratio-ETACO-ETAH2 parameter called CEEP.

In the scheme of the invention, the top gas emitted from the furnace is continuously accurately analyzed and the analyses are stored in a computer. An average of the analyses is determined periodically, for example every hour. The average of the analyses is used in mass and heat balance calculations to determine the high temperature heat (HTH) and CEEP values for that period. The high temperature heat (HTH) and CEEP values for each period are stored in the computer. When the CEEP values are relatively constant, the assumption of uniform conditions is valid and control of the furnace is based on the high temperature heat (HTH) parameter. The difference between the periodically determined high temperature heat (HTH) value during the present time of operation and the value of the average high temperature heat $(HTH)_{ave}$ for a preselected period of operation, which can be as much as the previous 24 hours, is identified as DEL1. The sum of the DEL1 values for the current periodic time of operation and the previous periodic time of operation is identified as DEL2. The preselected period of blast furnace operation for the average high temperature heat $(HTH)_{ave}$ calculation is the most recent period during which the average silicon content of the hot metal produced was within a predetermined range of the aim silicon content. The values of DEL1 and DEL2 indicate the changes which may be required in the temperature and/or moisture content of the hot air blown into the furnace through the tuyeres of the furnace to produce hot metal of substantially uniform composition.

If the average CEEP for the most recent period, which can be as short as 9 hours, differs significantly from the average for the previous period which can be as much as 24 hours, then the assumption of uniformity is not valid. In this situation, changes based on the difference of these CEEP averages would be recommended in the temperature and/or moisture content of the blast air.

PREFERRED EMBODIMENT OF THE INVENTION

According to this invention, there is provided a feedback control scheme to maintain a substantially uniform operation of the blast furnace to thereby produce high quality hot metal characterized by having a uniform chemical composition characterized by a silicon content within a predetermined range, e.g., 0.40 to 1.0 weight percent.

The reduction of iron-bearing materials to produce hot metal, for example molten basic iron, having a typical analysis of 4.5 weight percent carbon, 0.7 weight percent manganese, 0.1 weight percent phosphorus, 0.03 weight percent sulfur, 0.8 weight percent silicon and the remainder iron and incidental impurities associated with such products in a blast furnace, requires large quantities of heat, usually identified as millions of British thermal units per net ton of hot metal produced ($\overline{M}$BTU/NTHM) or Kilocalories per kilogram of hot metal (Kcal/Kg). Some of the heat is obtained by blowing hot blast air under pressure and at a temperature which may be within the range of 1400° F. (760° C.) to 2400° F. (1315° C.) into the furnace through the furnace tuyeres near the bottom of the furnace.

The scheme is based on the values of a high temperature heat parameter (HTH) and a coke-consumption-ratio ETACO-ETAH2 parameter (CEEP), determined by using continuously analyzed top gas data in mass and heat balance calculations. It is essential that the analyses of the top gas used in the mass and heat balance calculations be of the utmost accuracy because the HTH and CEEP parameters are highly sensitive to variations in the top gas data. It is well known to one skilled in the art that accurate top gas data can be obtained by the use of well-known instruments, such as infrared analyzers used to determine carbon monoxide and carbon dioxide contents and thermal conductivity cells to determine the hydrogen content. A method and use of such instruments to accurately analyze top gas is described in an article entitled "Continuous Multiple Blast Furnace Top Gas Analysis at Lackawanna," Walter N. Bargeron and John A. Carpenter, appearing in the *ISS-AIME Proceedings of the 39th Ironmaking Conference,* Vol. 39, pp. 73–80, Mar. 23–26, 1980, Washington, D.C.

The top gas analyses are stored in a computer which can be of the digital type. Periodically, the compositions of the top gas so stored are averaged. The period so selected may be as short as 30 minutes and as long as two hours, but is is preferred that the period be one hour and such period will be used in this specification for explanation purposes. Therefore, the average of the top gas data for a period of one hour is used in mass and heat balance calculations to determine the values of the high temperature heat for one hour $(HTH)_h$ and $(CEEP)_h$. If the $(CEEP)_h$ values are fairly constant, the assumption of uniform burden composition and weight and uniform reaction efficiencies are valid. Under these conditions furnace control based on HTH is valid. The $(HTH)_h$ determined for each hour is stored in the computer in order to determine an average $(HTH)_{ave}$ value for a predetermined period of blast furnace operation. The period of operation may be only 12 hours or may be as long as 36 hours but it is preferred to use a 24-hour period of operation and such period will be used hereinafter for explanation purposes. At the expiration of each hour, an average value of the $(HTH)_h$ is determined. This value is identified as $(HTH)_{24ave}$. To obtain a substantially uniform operation of the blast furnace to produce hot metal, whether it be basic iron or foundry iron, it is necessary that the $(HTH)_{24ave}$ be selected for the most recent 24 hour period during which the silicon content of the hot metal produced was within a predetermined range, for example plus or minus 0.1 weight percent, of the aim silicon content specified for the hot metal. The value of the $(HTH)_{24ave}$ is compared to the value of the high temperature heat of the current hour of operation, identified as $(HTH)_1$. The difference between $(HTH)_1$ and $(HTH)_{24ave}$, i.e. $(HTH)_1-(HTH)_{24ave}$, is identified as DEL1. The sum of DEL1 for the current hour and DEL1 for the previous hour is identified as DEL2. The values of DEL1 and DEL2 are used to determine any change which is to be made in the temperature and/or moisture content of the hot blast air fed into the furnace through its tuyeres. By thus regulating the temperature and/or moisture content of the hot blast air when $(CEEP)_h$ is relatively constant, it is possible to maintain a substantially uniform operation of the blast furnace.

The (HTH) in the furnace can be altered by increasing or decreasing the temperature and/or moisture of the hot blast air introduced into the furnace. If DEL2 is greater than a value within the range of about 0.2 and 0.25 $\overline{M}$BTU/NTHM (55 and 70 Kcal/Kg), and DEL1 for both the current hour and the previous hour of operation is greater than a value within the range of about 0.05 and 0.09 $\overline{M}$BTU/NTHM (14 and 24 Kcal/Kg), the furnace is heating up and a decrease in heat is required. The change in heat may be in either or both the temperature and moisture content of the hot blast air. Generally a full heat change is defined as increasing or decreasing the temperature of the incoming hot blast air by about 40° F. (22° C.) or increasing or decreasing the moisture content of the hot blast air by about 2 grains per cubic foot (5 g/cubic meter) and a half change is defined as 20° F. (11° C.) or 1 grain per cubic foot (2 g/cubic meter). The HTH is inversely related to the moisture content in the hot blast air. Increasing the moisture content decreases the HTH and decreasing the moisture content increases the HTH. If DEL2 is less than a value within the range of −0.2 and −0.25 $\overline{M}$BTU/HTHM (−55 and −70 Kcal/Kg) and DEL1 for each of the current hour and previous hour of operations is less than a value within the range of −0.05 and −0.09 $\overline{M}$BTU/NTHM (−14 and −24 Kcal/Kg), the furnace is cooling down and an increase in heat is required. If DEL2 is greater than a value between about 0.35 and 0.45 $\overline{M}$BTU/NTHM (95 and 125 Kcal/Kg) and DEL1 for each of the two hours is greater than a value between about 0.05 and 0.09 $\overline{M}$BTU/NTHM (15 and 25 Kcal/Kg), the furnace is heating up strongly and must be cooled-down with a large heat decrease, for example one and one-half heat changes. The heat decrease may be as much as a 100° F. (56° C.) decrease in blast air temperature or an increase of as much as 5 grains per cubic foot (11 g/cubic meter) of moisture in the blast air. If DEL2 is less than a value between −0.35 and −0.45 $\overline{M}$BTU/NTHM (−95 and −125 Kcal/Kg) and DEL1 is less than a value between −0.05 and −0.09 $\overline{M}$BTU/NTHM (−15 and −25 Kcal/Kg), the furnace is cooling down strongly and a large heat increase, for example one and one-half heat changes are required. The heat increase may be as much as 100° F. (56° C.) in blast air temperature or a decrease of as much as 5 grains per cubic foot of moisture (11 g/cubic meter) in the blast air.

a heat decrease is required, for example, 1½ heat changes.

A specific example of the method of the invention is shown in the Table produced below:

TABLE REPRESENTING THE METHOD OF THE INVENTION

| Hour of Operation | DEL2 $\overline{M}$BTU/NTHM (Kcal/Kg) | DEL1 $\overline{M}$BTU/NTHM (Kcal/Kg) | $(\overline{CEEP})_{13hr} - (\overline{CEEP})_p$ | Silicon (Wt. %) | Blast Temperature Changes Recommended °F. | Recommended (°C.) | Actual °F. | Actual (°C.) |
|---|---|---|---|---|---|---|---|---|
| 1 | | −.09 (−25) | .006 | .87 | | | | |
| 2 | −.18 (−50) | −.09 (−25) | .006 | | +20 | (+11) | +20 | (+11) |
| 3 | | −.05 (−14) | .007 | | | | | |
| 4 | | +.08 ( +8) | .007 | .65 | | | | |
| 5 | | −.01 ( −3) | .008 | | | | | |
| 6 | | −.13 (−36) | .009 | | | | | |
| 7 | | +.09 (+25) | .010 | .82 | | | | |
| 8 | | +.04 (+11) | .012 | | | | | |
| 9 | | +.13 (+36) | .014 | | | | | |
| 10 | | +.05 (+14) | .016 | .85 | | | | |
| 11 | | −.06 (−17) | .018 | | +100 | (+55) | +100 | (+55) |
| 12 | | −.04 (−11) | .005 | | | | | |
| 13 | | −.09 (−25) | .005 | .82 | | | | |
| 14 | | +.07 (+19) | .004 | | | | | |
| 15 | | −.07 (−19) | .004 | | | | | |
| 16 | | −.07 (−19) | .004 | .70 | | | | |
| 17 | | −.03 ( −8) | .005 | | | | | |
| 18 | | −.11 (−30) | .006 | | | | | |
| 19 | −.22 (−60) | −.11 (−30) | .006 | .62 | +40 | (+22) | +40 | (+22) |
| 20 | −.34 (−94) | −.23 (−64) | .005 | | | | | |
| 21 | −.55 (−153) | −.32 (−89) | .005 | | +60 | (+33) | +60 | (+33) |
| 22 | −.54 (−150) | −.22 (−61) | .005 | .61 | | | | |
| 23 | −.30 (−83) | −.08 (−22) | .003 | | +40 | (+22) | +40 | (+22) |
| 24 | −.23 (−64) | −.15 (−42) | .002 | .58 | | | | |

When the burden weights, compositions and properties are not uniform, control based solely on a high temperature heat (HTH) parameter is not valid. In order to compensate for these nonuniformities, control changes are made on the basis of CEEP. When the average CEEP for the past few hours, which could be between 9 and 15 hours, is more than the average for the previous period $CEEP_p$, which could be between 18 and 36 hours, by a value within the range of 0.015 and 0.025 and the average CEEP for the last few hours, which could be between 5 and 8 hours, is greater than $CEEP_p$ by a value within the range of 0.02 and 0.03 then a serious problem in the burden characteristics exists and a very large heat increase is required, for example 2½ heat changes.

When the average CEEP for the past few hours, which could be between 9 and 15 hours, is more than the average for the previous period $\overline{CEEP}_p$, which could be between 18 and 36 hours, by a value within the range of 0.015 and 0.025, and the average CEEP for the last few hours, which could be between 5 and 8 hours, is not greater than $\overline{CEEP}_p$ by a value within the range of 0.02 and 0.03 then a heat increase is required, for example 1½ heat changes.

When heat is added because of CEEP, DEL1 values for the next few hours, which could be between 3 and 12 hours, are decreased by a value in the range 0.02 and 0.05 $\overline{M}$BTU/NTHM (5 and 14 Kcal/Kg) in order to reduce the probability of the heat being removed because the high temperature heat is too high.

When the average CEEP for the past few hours, which could be between 9 and 15 hours, is less than the average for the previous period, $(\overline{CEEP})_p$, which could be between 18 and 36 hours, by a value within the range 0.02–0.03 and the average CEEP for the last few hours, which could be between 5 and 8 hours, is less than $(\overline{CEEP})_p$ by a value within the range 0.025 and 0.03 then The Table represents a period of 24 hours of operation during which the method of the invention was used to control the operation of the furnace wherein changes were made in the temperature of the blast air to maintain a substantially uniform operation of the blast furnace and to maintain a silicon content between 0.4 and 1.0 weight percent in the hot metal cast from the furnace. In this example, a normal heat change was 40° F. (22° C.), a large heat change was 60° F. (33° C.), and a very large heat charge was 100° F. (55° C.) in the blast air temperature. The hot metal processed during this period was basic iron used to produce steel in basic oxygen furnaces.

An increase in blast air temperature of 40° F. (22° C.) will lead to a 0.12 weight percent increase in the silicon content of hot metal cast about 6 to 9 hours after the change. Conversely, a 40° F. (22° C.) decrease in blast air temperature will lead to a 0.12 weight percent decrease in the silicon content of hot metal about 6 to 9 hours after the decrease.

It is standard practice in the operation of a blast furnace that when the silicon content of the hot metal from the furnace is low or is decreasing for successive casts the blast air temperature is increased. Conversely, when the silicon content of the hot metal is high or increasing, the blast air temperature is decreased.

Turning now to the Table, at the beginning of the 24 hour period the silicon content was above the aim silicon content of 0.8 weight percent and the scheme recommended that heat be added because the available heat, as measured by DEL1 and DEL2, was low. During the next 8 hours the available heat and the silicon values were within their acceptable limits. At the 11th hour a very large heat change recommendation of 100° F. (55° C.) was recommended and made because there was a large increase in the necessary heat, as measured by $(\overline{CEEP})_{13\ hr}-(\overline{CEEP})_p$ which in this case was the difference between the average CEEP value for the last 13 hours, $(\overline{CEEP})_{13\ hr}$, and the average for the previous 24-hour period. After the heat change recommendation for CEEP, $(\overline{CEEP})_p$ is adjusted. The effect of this adjustment is shown by the drop in $(\overline{CEEP})_{13\ hr}-(CEEP)_p$ from the 12th hour to the 13th hour. Based on both the normal operating practice of using silicon analyses to decide upon necessary heat changes and the control procedure governed by available heat terms that are calculated from mass and energy balances, there was no indication of a need to add heat until possibly the 17th hour. Since a 100° F. (55° C.) blast air temperature increase results in an increase of silicon content of about 0.3 weight percent 6 to 9 hours later, the silicon content of the casts between hours 19–24 would have been 0.25–0.35 weight percent, if the other control procedures had been followed; and this hot metal would not have been acceptable for steelmaking purposes.

It can be seen that the recommendations suggested by the method of the invention, although contrary to standard procedures, resulted in a relatively uniform furnace operation and the production of hot metal with a silicon content well within the range of 0.4 to 1.0 weight percent for basic iron used to produce steel in steelmaking furnaces, for example a basic oxygen furnace.

I claim:

1. A feedback control scheme for maintaining a substantially uniform operation of a blast furnace wherein solid iron-containing materials, carbon-containing fuel and fluxstone are charged into the top of the furnace and pass downwardly in the furnace and pressurized heated blast air is passed into the furnace through its tuyeres into the tuyere region of the furnace and the oxygen in the blast air combines with carbon in the fuel to provide reducing gases and high temperature heat that are required to melt and reduce the iron-containing materials to produce molten iron containing a desired silicon content, which molten iron is collected in the hearth of the furnace and to melt the fluxstone, which reacts with impurities charged into the furnace to form a fluid slag which floats atop the molten iron and protects the molten iron from impurities, the scheme comprising:

(a) continuously accurately analyzing the composition of the top gas emitted from the furnace, (b) storing the analyses in a computer, (c) determining an average of the top gas analyses at a predetermined period of time, (d) determining a high temperature heat (HTH) value and a (CEEP) value for each period of time using the average of the top gas analyses determined in step (c) in mass and heat balance calculations, (e) storing the (HTH) values and CEEP values determined in step (d) in the computer, (f) determining a base period of operation of the blast furnace wherein the silicon content of the hot metal produced was within a predetermined range of the aim silicon content for the type of hot metal produced, (g) determining the average of the high temperature heat values as determined in step (d) from a base period of operation of step (f), (h) determining a difference between the high temperature heat for a current period of operation and the average value of the high temperature heat of step (g), which difference may be identified as DEL1, (i) determining the sum of the values from step (h) for the current hour and previous hour of operation, which sum may be identified as DEL2, (j) determining the average of the CEEP values of a recent period of operation, (k) determining the difference between the CEEP average of step (j) and the average CEEP for a prior period of operation, and (l) regulating the temperature and/or moisture content of the hot blast air as recommended by the values of DEL1 in step (h), DEL2 in step (i), and the CEEP difference in step (k).

2. The method of claim 1 wherein the silicon content of the hot metal is within the range of about 0.4 and 1.0 weight percent.

3. The method of claim 1 wherein the temperature of the hot blast air is increased by between about 20° F. (11° C.) and 100° F. (55° C.) in step (l).

4. The method of claim 1 wherein the temperature of the hot blast air is decreased by between about 20° F. (11° C.) and 100° F. (55° C.) in step (l).

5. The method of claim 1 wherein the moisture content of the hot blast air is increased by between 1 and 5 grains per cubic foot (2 and 11 g per cubic meter) in step (l).

6. The method of claim 1 wherein the moisture content of the hot blast air is decreased by between 1 and 5 grains per cubic foot (2 and 11 g per cubic meter) in step (l).

7. The method of claim 1 wherein the temperature and moisture of the hot blast air remain essentially the same.

8. The method of claim 1 wherein each period of time in step (c) is between 30 minutes and two hours.

9. The method of claim 1 wherein each period of time in step (c) is about one hour.

10. The method of claim 1 wherein the base period of operation in step (f) is between 12 hours and 36 hours.

11. The method of claim 1 wherein the base period of operation in step (f) is about 24 hours.

12. The method of claim 1 wherein the recent period of operation in step (j) could be as much as 15 hours and as little as 9 hours.

13. The method of claim 1 wherein the prior period of operation in step (k) is between 18 and 36 hours before the step (j) period.

14. The method of claim 1 wherein the value of DEL1 of step (h) is less than a value between −0.05 and −0.09 $\overline{M}$BTU/NTMH (−14 and −24 Kcal/Kg) and the value of DEL2 of step (i) is less than a value between −0.2 and −0.25 $\overline{M}$BTU/NTHM (−55 and −70 Kcal/Kg) and the temperature of the hot blast air in step (l) is increased by between about 20° F. and 60° F. (11° C. and 33° C.).

15. The method of claim 1 wherein the value of DEL1 of step (h) is greater than a value between 0.05 and 0.09 $\overline{M}$BTU/NTMH (14 and 24 Kcal/Kg) and the value of DEL2 of step (i) is greater than a value between 0.2 and 0.25 $\overline{M}$BTU/NTHM (55 and 70 Kcal/Kg) and the temperature of the hot blast air in step (l) is decreased by between about 20° F. and 60° F. (11° C. and 33° C.).

16. The method of claim 1 wherein the value of DEL1 of step (h) is less than a value between −0.05 and −0.09 $\overline{M}$BTU/NTHM (−14 and −24 Kcal/Kg) and the value of DEL2 of step (i) is less than a value between −0.2 and −0.25 $\overline{M}$BTU/NTHM (−55 and −70 Kcal/Kg), and the moisture content of the hot blast air in step (l) is decreased by between 1 and 5 grains per cubic foot (2 and 11 g per cubic meter).

17. The method of claim 1 wherein the value of DEL1 of step (h) is greater than a value between 0.05 and 0.09 $\overline{M}$BTU/NTHM (14 and 24 Kcal/Kg) and the value of DEL2 of step (i) is greater than a value between 0.2 and 0.25 $\overline{M}$BTU/NTHM (55 and 70 Kcal/Kg), and the moisture content of the hot blast air in step (l) is increased by 1 to 5 grains per cubic foot (2 and 11 g per cubic meter).

18. The method of claim 1 wherein the value of DEL1 of step (h) is greater than a value between 0.05 and 0.09 $\overline{M}$BTU/NTHM (14 and 24 Kcal/Kg) and the value of DEL2 of step (i) is greater than a value between 0.35 and 0.45 $\overline{M}$BTU/NTHM (95 and 125 Kcal/Kg), and the temperature of the hot blast air in step (l) is decreased by between 40° F. and 100° F. (22° C. and 55° C.).

19. The method of claim 1 wherein the value of DEL1 of step (h) is less than between −0.05 and −0.09 $\overline{M}$BTU/NTHM (−14 and −24 Kcal/Kg), and DEL2 of step (i) has the value less than between −0.35 and −0.45 $\overline{M}$BTU/NTHM (−95 and −125 Kcal/Kg) and the temperature of the hot blast air in step (l) is increased by between 40° F. and 100° F. (22° C. and 55° C.).

20. The method of claim 1 wherein DEL1 of step (h) has a value which is greater than between 0.05 and 0.09 $\overline{M}$BTU/NTHM (14 and 24 Kcal/Kg) and DEL2 of step (i) has a value greater than between 0.35 and 0.45 $\overline{M}$BTU/NTHM (95 and 125 Kcal/Kg), and the moisture content of the hot blast air is increased by between 2 and 5 grains per cubic foot (5 and 11 g/cubic meter).

21. The method of claim 1 wherein DEL1 of step (h) has a value which is less than between −0.05 and −0.09 $\overline{M}$BTU/NTHM (−14 and −24 Kcal/Kg) and DEL2 of step (i) has a value less than between −0.35 and −0.45 $\overline{M}$BTU/NTHM (−95 and −125 Kcal/Kg), and the moisture content of the the hot blast air in step (l) is decreased by between 2 and 5 grains per cubic foot (5 and 11 g/cubic meter).

22. The method of claim 1 wherein the difference between the CEEP values for a recent period of operation and for a period of operation prior to such period is greater than a value between 0.015 and 0.025 and the temperature of the hot blast air is increased by between 40° F. and 140° F. (22° C. and 78° C.).

23. The method of claim 1 wherein the difference between the CEEP values for a recent period of operation and for a period of operation prior to that period is greater than a value between 0.015 and 0.025 and the moisture content of the hot blast air is decreased by between 2 and 5 grains per cubic foot (5 and 11 g/cubic meter).

24. The method of claim 1 wherein the difference between the CEEP values for a recent period of operation and for a period of operation prior to that period of operation is less than a value between −0.015 and −0.025 and the temperature of the hot blast air is decreased by between 40° 140° F. (22° C. and 78° C.).

25. The method of claim 1 wherein the difference between the CEEP values of a recent period of operation and for a period of operation prior to that period of operation is less than a value between −0.015 and −0.025 and the moisture content of the hot blast air is increased by between 2 and 5 grains per cubic foot (5 and 11 g/cubic meter).

* * * * *